US007243869B2

(12) United States Patent
Hur et al.

(10) Patent No.: US 7,243,869 B2
(45) Date of Patent: Jul. 17, 2007

(54) DISTRIBUTION STRUCTURE, VERTICAL SHAFT IMPACT CRUSHER HAVING THE DISTRIBUTION STRUCTURE AND METHOD OF FABRICATING THE DISTRIBUTION STRUCTURE

(76) Inventors: Hong-Soon Hur, 102-1301 Samsung Apt., 378-4 Chilsung 2-dong, Buk-gu, Daegu-si (KR); Jin-Kyung Hur, 102-1301 Samsung Apt., 378-4 Chilsung 2-dong, Buk-gu, Daegu-si (KR)

( * ) Notice: Subject to any disclaimer, the term of this patent is extended or adjusted under 35 U.S.C. 154(b) by 229 days.

(21) Appl. No.: 11/087,686

(22) Filed: Mar. 24, 2005

(65) Prior Publication Data

US 2005/0263636 A1 Dec. 1, 2005

(30) Foreign Application Priority Data

May 31, 2004 (KR) ..... 10-2004-0038892

(51) Int. Cl.
*B02C 19/00* (2006.01)

(52) U.S. Cl. ..... 241/275

(58) Field of Classification Search ..... 241/275, 241/301

See application file for complete search history.

(56) References Cited

U.S. PATENT DOCUMENTS

| | | | | |
|---|---|---|---|---|
| 3,767,127 | A * | 10/1973 | Wood | 241/275 |
| 5,135,177 | A | 8/1992 | Okuhara | |
| 7,028,936 | B2 * | 4/2006 | Condon | 241/275 |
| 2006/0011762 | A1 * | 1/2006 | Dallimore et al. | 241/275 |
| 2006/0138265 | A1 * | 6/2006 | Strauss et al. | 241/275 |

* cited by examiner

*Primary Examiner*—Mark Rosenbaum
(74) *Attorney, Agent, or Firm*—Lowe Hauptman & Berner LLP

(57) ABSTRACT

A distribution structure of a vertical shaft impact crusher includes a core having a hole into which a vertical shaft is inserted. A distribution member for horizontally distributing an aggregate that is vertically provided to the crusher is fused on an outer face of the core. The distribution member includes a plurality of clustered scrapped tips including hard metal, and a fusion material interposed between the scrapped tips to connect the scrapped tips to each other.

4 Claims, 7 Drawing Sheets

DISTRIBUTION STRUCTURE, VERTICAL SHAFT IMPACT CRUSHER HAVING THE DISTRIBUTION STRUCTURE AND METHOD OF FABRICATING THE DISTRIBUTION STRUCTURE

CROSS REFERENCE TO RELATED APPLICATION

This application claims priority under 35 USC § 119 to Korean Patent Application No. 2004-38892, filed on May 31, 2004, the content of which is herein incorporated by reference in its entirety for all purposes.

BACKGROUND OF THE INVENTION

1. Field of the Invention

The present invention relates to a distribution structure, a vertical shaft impact crusher having the distribution structure and a method of fabricating the distribution structure. More particularly, the present invention relates to a distribution structure for horizontally distributing an aggregate that is supplied in a vertical shaft impact crusher for pulverizing the aggregate into gravels and sands, a vertical shaft impact crusher having the distribution structure and a method of fabricating the distribution structure.

2. Description of the Related Art

A natural aggregate is pulverized using a crusher in accordance with various applications. The crusher includes a vertical shaft impact crusher. The vertical shaft impact crusher pulverizes the natural aggregate by crushing a highly accelerated aggregate against a crushing face. The vertical shaft impact crusher may be classified into an anvil type crusher and a rock-on-rock type crusher.

FIG. 1 is a cross sectional view illustrating a conventional anvil type impact crusher that is disclosed in U.S. Pat. No. 5,135,177.

Referring to FIG. 1, a conventional impact crusher includes a crushing chamber 1 and a feeding hopper 2 disposed over the crushing chamber 1. A rotor 3 for providing a centrifugal force to an aggregate is positioned in the crushing chamber 1. The aggregate is loaded into the rotor 3 through the feeding hopper 2. A conoid distribution structure 5 is arranged at a central portion of a bottom face of the rotor 3. The distribution structure 5 distributes the aggregate, which is vertically loaded into the rotor 3, in a horizontal direction. The distribution structure 5 is fixed to a vertical shaft for rotating the rotor 3 so that the distribution structure 5 is rotated together with the rotor 3. An anvil 4 is mounted on an inner wall of the crushing chamber 1. The aggregate is crushed against the anvil 4.

The aggregate loaded into the rotor 3 is crushed against the distribution structure 5 and is then moved in the horizontal direction. Thus, the distribution structure 5 together rotated with the rotor 3 violently chafes against the aggregate so that the distribution structure 5 is readily worn. As a result, the distribution structure 5 is periodically replaced with new one.

Meanwhile, the conventional distribution structure 5 includes high chromium steel. The distribution structure 5 including high chromium steel may have life span of about 150 hours. Thus, the conventional vertical shaft impact crusher is suspended at an interval of about 150 hours to replace the distribution structure 5 with new one. This causes reduction of an operational efficiency of the conventional vertical shaft impact crusher.

To overcome the above-mentioned problem, ceramic or tungsten carbide having a wear resistance higher than that of high chromium steel may be used for a material of the conventional distribution structure. However, although the conventional distribution structure including ceramic or tungsten carbide has life span of about 10 times to about 15 times longer than that of the distribution structure including high chromium steel, ceramic or tungsten carbide is more expensive than high chromium steel so that cost for fabricating the distribution structure including ceramic or tungsten carbide is about 30 times to about 40 times more expensive than that for fabricating the distribution structure including high chromium steel. As a result, ceramic or tungsten carbide may not be realistically used for a material of the distribution structure in the light of economy.

SUMMARY OF THE INVENTION

The present invention provides a distribution structure of a vertical shaft impact crusher that has a good wear resistance.

The present invention also provides a vertical shaft impact crusher having the above-mentioned distribution structure.

The present invention still also provides a method of fabricating the above-mentioned distribution structure.

A distribution structure of a vertical shaft impact crusher in accordance with one aspect of the present invention includes a core having a hole into which a vertical shaft is inserted. A distribution member for horizontally distributing an aggregate that is vertically provided in the crusher is fused on an outer face of the core. The distribution member includes a plurality of clustered scrapped tips including hard metal, and a fusion material interposed between the scrapped tips to connect the scrapped tips to each other.

A vertical shaft impact crusher in accordance with another aspect of the present invention includes a crushing housing. A feeding hopper for providing an aggregate into the crushing housing is arranged over the crushing housing. A rotor for providing a centrifugal force to the aggregate is arranged in the crushing housing. A distribution structure for horizontally distributing the aggregate is arranged on a bottom face of the rotor. The distribution structure is connected to the rotor via a vertical shaft. The distribution structure includes a core having a hole into which the vertical shaft is inserted, and a distribution member fused on an outer face of the core. The distribution member includes a plurality of clustered scrapped tips including hard metal, and a fusion material interposed between the scrapped tips to connect the scrapped tips to each other. An anvil against which the aggregate discharged from the rotor by the distribution structure is crushed is mounted on an inner wall of the crushing housing.

In a method of fabricating a distribution member in accordance with still another aspect of the present invention, a case having a shape corresponding to that of a distribution structure is prepared. A core is mounted in the case. A plurality of scrapped tips including hard metal fills a space between the core and the case. A melted fusion material is provided to gaps between the scrapped tips to fuse the scrapped tips with each other as well as the case and the core.

According to the present invention, the distribution structure includes the scrapped tips including hard metal so that the cheap distribution structure may have improved wear resistance. As a result, the distribution structure has a long life span So that a periodic time for exchanging the distribution structure may be prolonged.

BRIEF DESCRIPTION OF THE DRAWINGS

The above and other features and advantages of the invention will become readily apparent by reference to the following detailed description when considered in conjunction with the accompanying drawings wherein.

DESCRIPTION OF THE PREFERRED EMBODIMENTS

Figure 1:
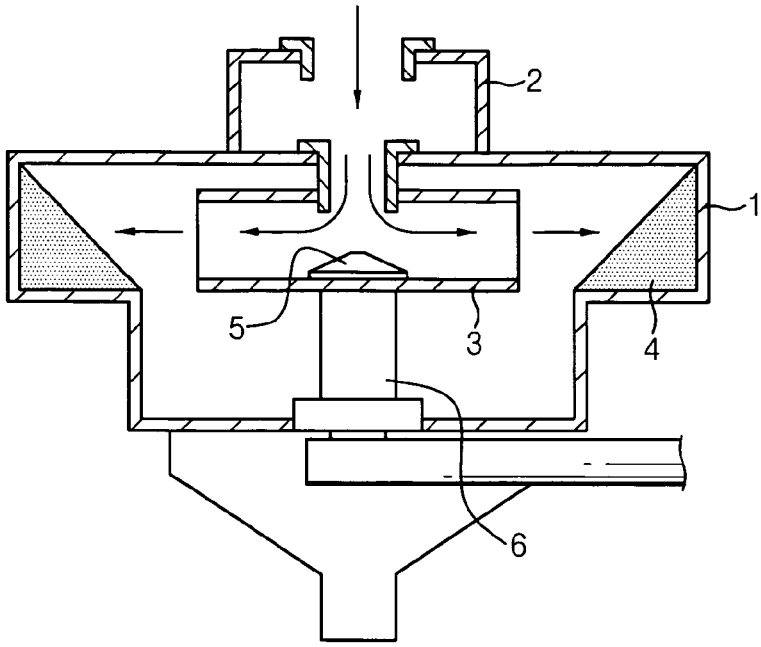
FIG. 1 (PRIOR ART)
FIG. 1 is a cross sectional view illustrating a conventional vertical shaft impact crusher.

The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to similar or identical elements throughout.

Figure 2:
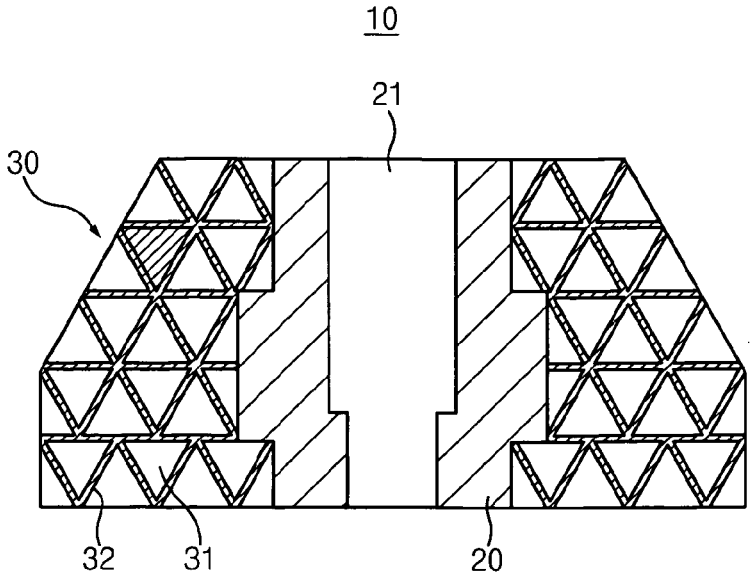
FIG. 2 is a cross sectional view illustrating a distribution structure in accordance with some embodiments of the present invention.

FIG. 2 is a cross sectional view illustrating a distribution structure in accordance with some embodiments of the present invention.

Referring to FIG. 2, a distribution structure 10 of the present embodiment includes a core 20 and a distribution member 30 mounted on an outer face of the core 20.

The core 20 has a hole 21 into which a vertical shaft (not shown) of an impact crusher (not shown) is inserted. A bolt (not shown) is threadedly inserted into the hole 21 to combine the core 20 with the vertical shaft.

The distribution member 30 includes a plurality of scrapped tips 31 and a fusion material 32 interposed between the scrapped tips 31. Here, the scrapped tips 31 may be obtained from an insert that is used for cutting a steel article. An example of the insert is hard metal such as tungsten carbide. Also, the insert may correspond to an insert for turning, an insert for milling, etc. When a cutting edge of the insert is worn, the insert may not be used for cutting the steel article. Thus, the insert having the worn cutting edge may be generally disused.

According to the present invention, the scrapped tips 31 obtained from the insert to be disused is used for the distribution structure 10. As described above, since the scrapped tips 31 include tungsten carbide, the distribution member 30 having the scrapped tips 31 has a good wear resistance with respect to an aggregate. Thus, the distribution member 30 may have a long life span.

Alternatively, the scrapped tips 31 may have various configurations in accordance with applications of the insert. For example, the scrapped tips 31 have a rectangular shape, a triangular shape, etc. Although the scrapped tips 31 in FIG. 2 have the triangular shape, the scrapped tips 31 of the present invention may have other shapes as well as the triangular shape.

The scrapped tips 31 have a clustered structure. The fusion material 32 is interposed between the scrapped tips 31 to form the clustered structure. The fusion material 32 fixes the scrapped tips 31 to the outer face of the core 20 and also to each other Examples of the fusion material 32 are copper, copper alloy, etc.

The distribution member 30 including the scrapped tips 31 and the fusion material 32 has a conoid shape. That is, the distribution member 30 includes an upper face and a lower face larger than the upper face. Thus, the aggregate vertically supplied to the distribution member 30 collides against the distribution member 30 and is then distributed in a horizontal direction.

Figure 3:
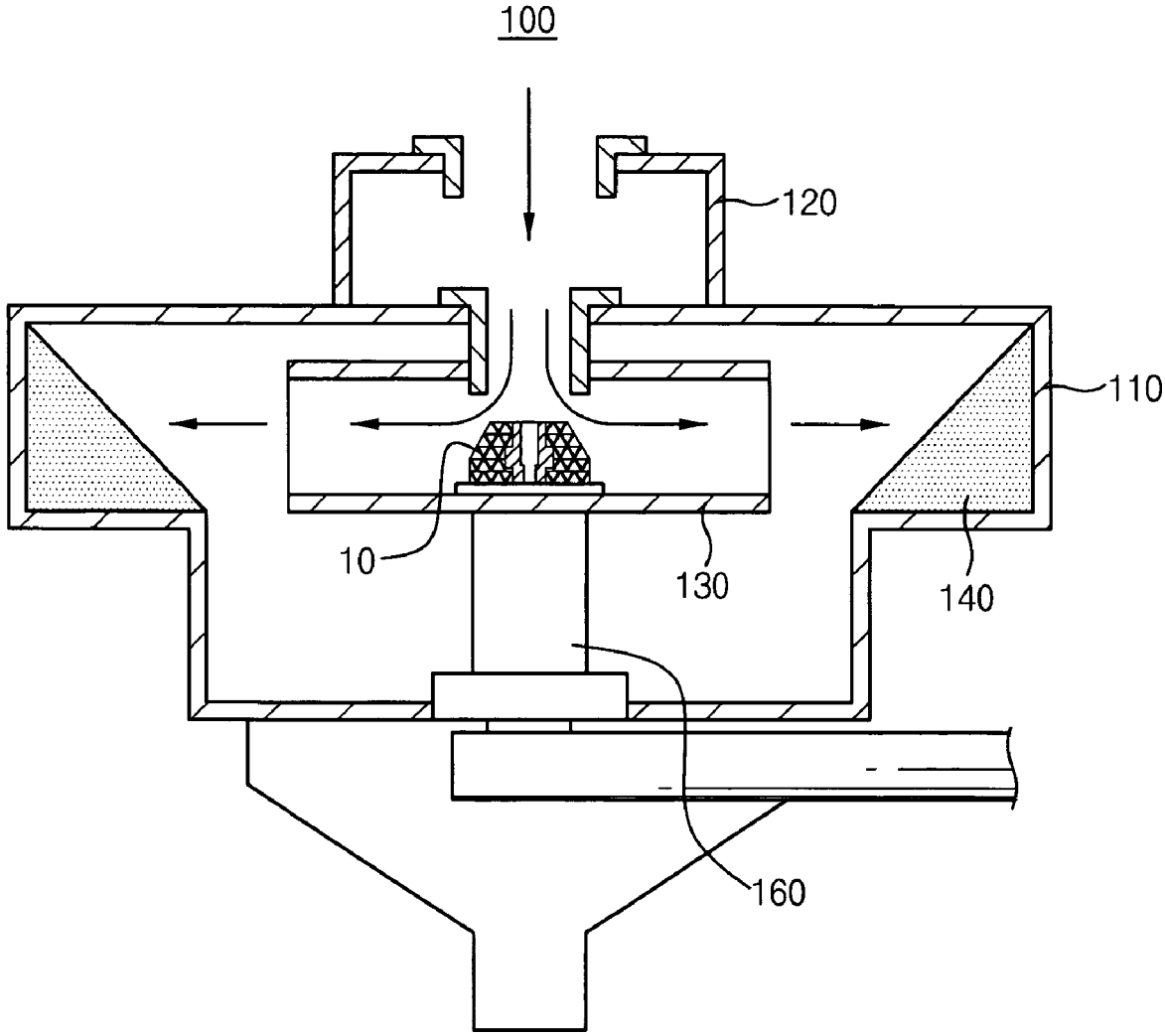
FIG. 3 is a cross sectional view illustrating a vertical shaft impact crusher having the distribution structure in FIG. 2.

FIG. 3 is a cross sectional view illustrating a vertical shaft impact crusher having the distribution structure in FIG. 2.

Referring to FIG. 3, a vertical shaft impact crusher 100 in accordance with the present embodiment includes a crushing chamber 110, a feeding hopper 120 arranged over the crushing chamber 110, and a rotor 130 arranged at an upper central portion of the crushing chamber 110 and being in communication with the feeding hopper 120. An aggregate is downwardly provided to the rotor 130 through the feeding hopper 120. The rotor 130 is connected to a vertical shaft 160 so that the rotor 130 is rotated together with the vertical shaft 160.

A conoid distribution structure 10 is arranged on a central bottom face of the rotor 130. The distribution structure 10 horizontally distributes the aggregate that is vertically supplied to the rotor 130. The distribution structure 10 is connected to the vertical shaft 160 so that the distribution structure 10 is rotated together with the rotor 130.

The distribution member 10 includes a core 20 and a distribution member 30 mounted on an outer face of the core 20. The core 20 has a hole 21 into which a vertical shaft 160 is inserted. The distribution member 30 includes a plurality of scrapped tips 31 including tungsten carbide and a fusion material 32 interposed between the scrapped tips 31.

An anvil 140 is mounted on an inner wall of the crushing chamber 110. The aggregate horizontally distributed by the distribution structure 10 collides against the anvil 140 to pulverize into gravels and sands.

The aggregate is downwardly supplied to the rotor 130 through the feeding hopper 120. The aggregate collides against the distribution structure 10, particularly the distribution member 30 and is then distributed in the horizontal direction.

Here, since the distribution member 30 includes the scrapped tips 31 including tungsten carbide, the distribution member 30 has a good wear resistance with respect to the aggregate. Thus, the distribution structure 10 has a long life span so that a periodic time for exchanging the distribution structure 10 may be prolonged. A running time of the vertical shaft impact crusher 100 may be increased.

The distributed aggregate collides against the anvil 140 to pulverize into the gravels and the sands. The gravels and the sands are discharged through an exit that is formed at a lower face of the crushing chamber 110.

FIGS. 4 to 8 are cross sectional views illustrating a method of fabricating the distribution structure in FIG.2.

Figure 4:
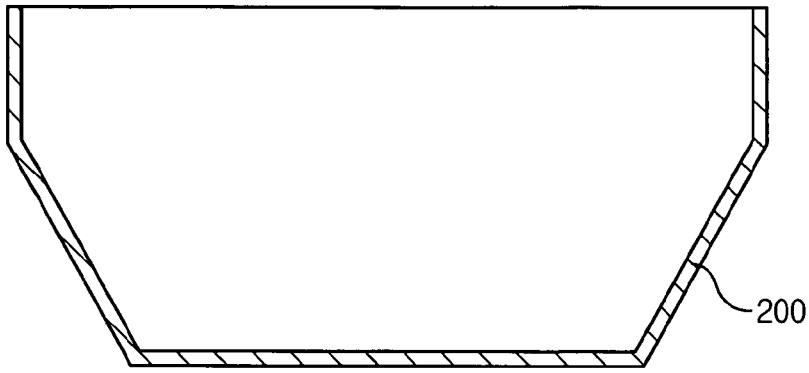
FIGS. 4 to 8 are cross sectional views illustrating a method of fabricating the distribution structure in FIG.2.

Referring to FIG. 4, a case 200 having a shape that corresponds to that of a distribution structure to be fabricated, for example, a conoid shape is prepared.

The case 200 may be fabricated by following methods. A steel plate (not shown) is placed on a die having a recessed portion that corresponds to the case 200. The steel plate is compressed using a punch to form the case 200 having a shape corresponding to that of the recessed portion.

Alternatively, a mold having a shape substantially identical to the distribution structure is mounted on a spinning machine. A steel plate is formed along the shape of the mold to form the case 200.

Also, steel plates corresponding to a bottom face, side face and a connecting face connected between the bottom face and the side face of the case 200 are prepared. The steel plates are welded with each other to form the case 200.

Figure 5:
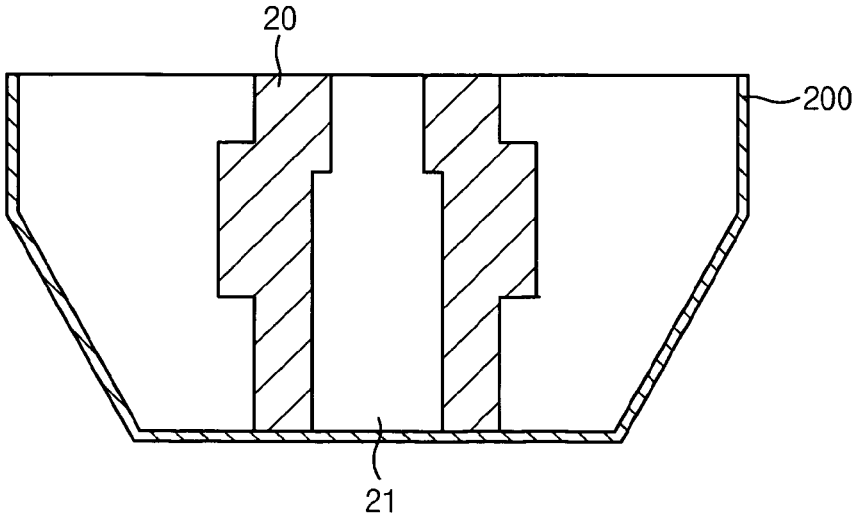

Referring to FIG. 5, a core 20 is welded on the bottom face of case 200. The core 20 may be formed by turning a rounded bar that includes carbon steel or alloy steel, using a lathe. In particular, the core 20 is placed on the bottom face of the case 200. The core 20 is secured to the case 200 by an oxyacetylene welding or an arc welding.

Figure 6:
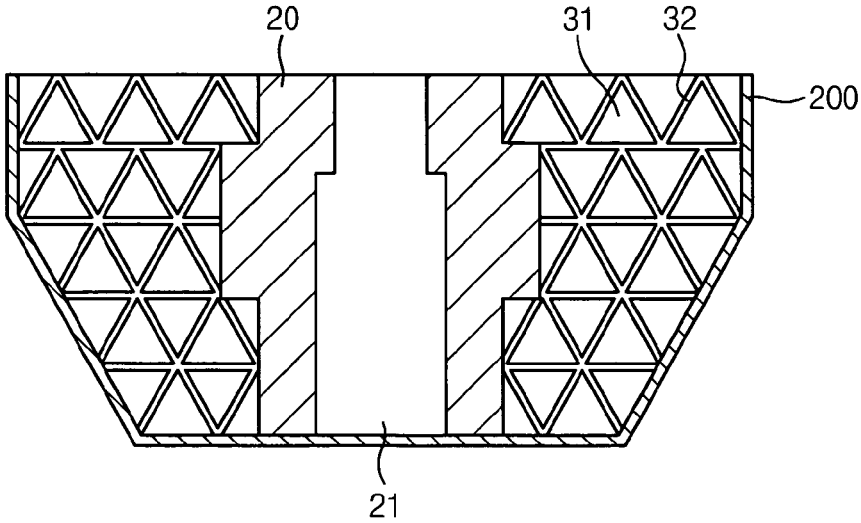

Referring to FIG. 6, a space between the case 200 and the core 20 is filled with the scrapped tips 31 including tungsten carbide. Gaps are formed between the scrapped tips 31 and the case 200, between the scrapped tips 31 and the core 20, and between the scrapped tips 31.

Figure 7:
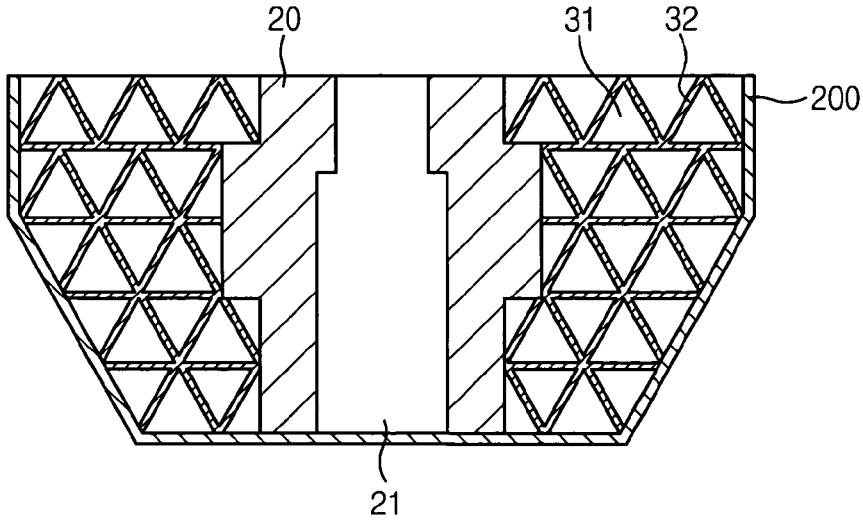

Referring to FIG. 7, the fusion material 32 is provided to the gaps to fill the gaps. Thus, the scrapped tips 31 are fused to each other and also to case 200 and the core via the fusion material 32.

Figure 8:
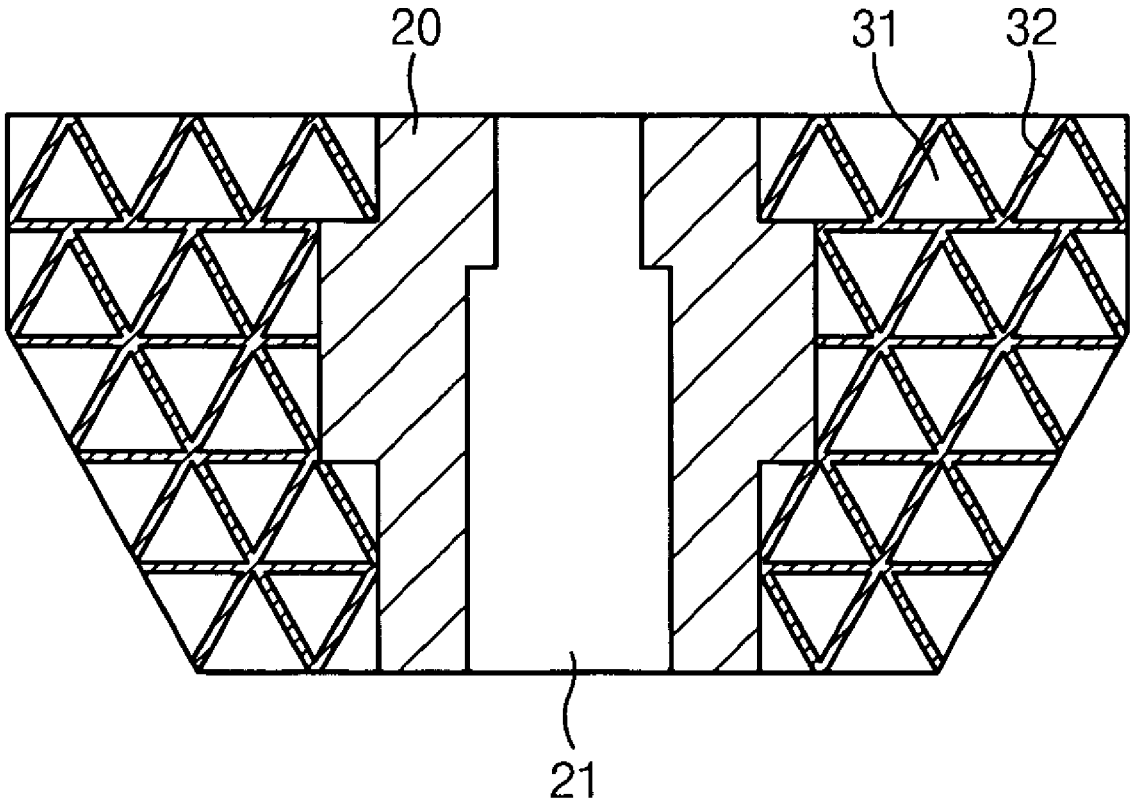

Referring to FIG. 8, the case 200 may be separated from the fused scrapped tips 31 and the core 20. Alternatively, the case 200 integrally formed with the distribution member 30 may be employed in the vertical shaft impact crusher.

Here, methods of fusing the scrapped tips 31 are as follows.

Figure 9:
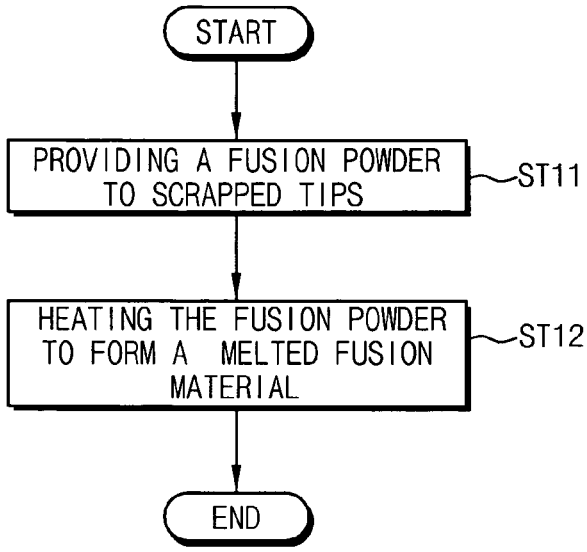
FIG. 9 is a flow chart illustrating a method of fusing scrapped tips in accordance with one embodiment.

FIG. 9 is a flow chart illustrating a method of fusing scrapped tips in accordance with one embodiment.

Referring to FIG. 9, in step ST11, a fusion powder including copper or copper alloy is provided to the gaps between the scrapped tips 31. In particular, the scrapped tips 31 are arranged to form a first single layer. The fusion powder is coated on the first single layer. Other scrapped tips 31 are arranged on the fusion powder to form a second single layer. The fusion powder is then coated on the second single layer. The above-mentioned processes are repeatedly carried out to form a structure including the scrapped tips 31 and the fusion powder stacked alternately in the case 200.

In step ST12, the case 200 is loaded into an electric furnace or a vacuum sintering furnace. The fusion powder is heated at a temperature of about 700° C. to about 1,200° C. to melt fusion powder. The scrapped tips 31 are secured to each other, the case 200 and the core 20 via the melted fusion powder.

Figure 10:
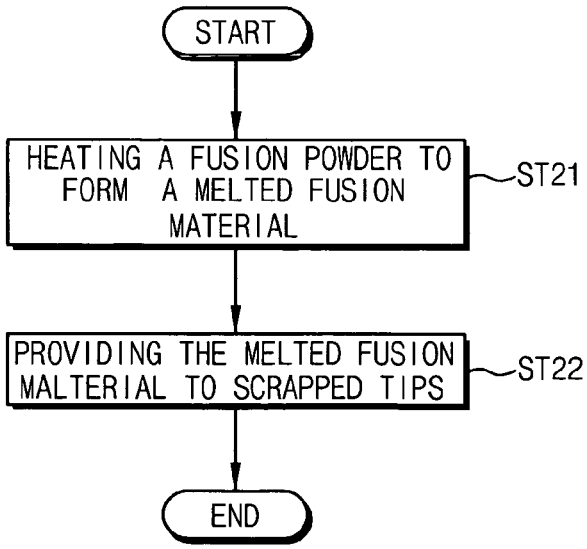
FIG. 10 is a flow chart illustrating a method of fusing scrapped tips in accordance with another embodiment.

FIG. 10 is a flow chart illustrating a method of fusing scrapped tips in accordance with another embodiment.

Referring to FIG. 10, in step ST21, a fusion powder including copper or copper alloy is loaded into an electric furnace or a sintering furnace using vacuum. The fusion powder is heated and melted at a temperature of about 700° C. to about 1,200° C.

In step ST22, the melted fusion powder is provided to the case 200. The melted fusion powder is cooled to a normal temperature to fix the scrapped tips 31 to each other, the case 200 and the core 20.

Figure 11:
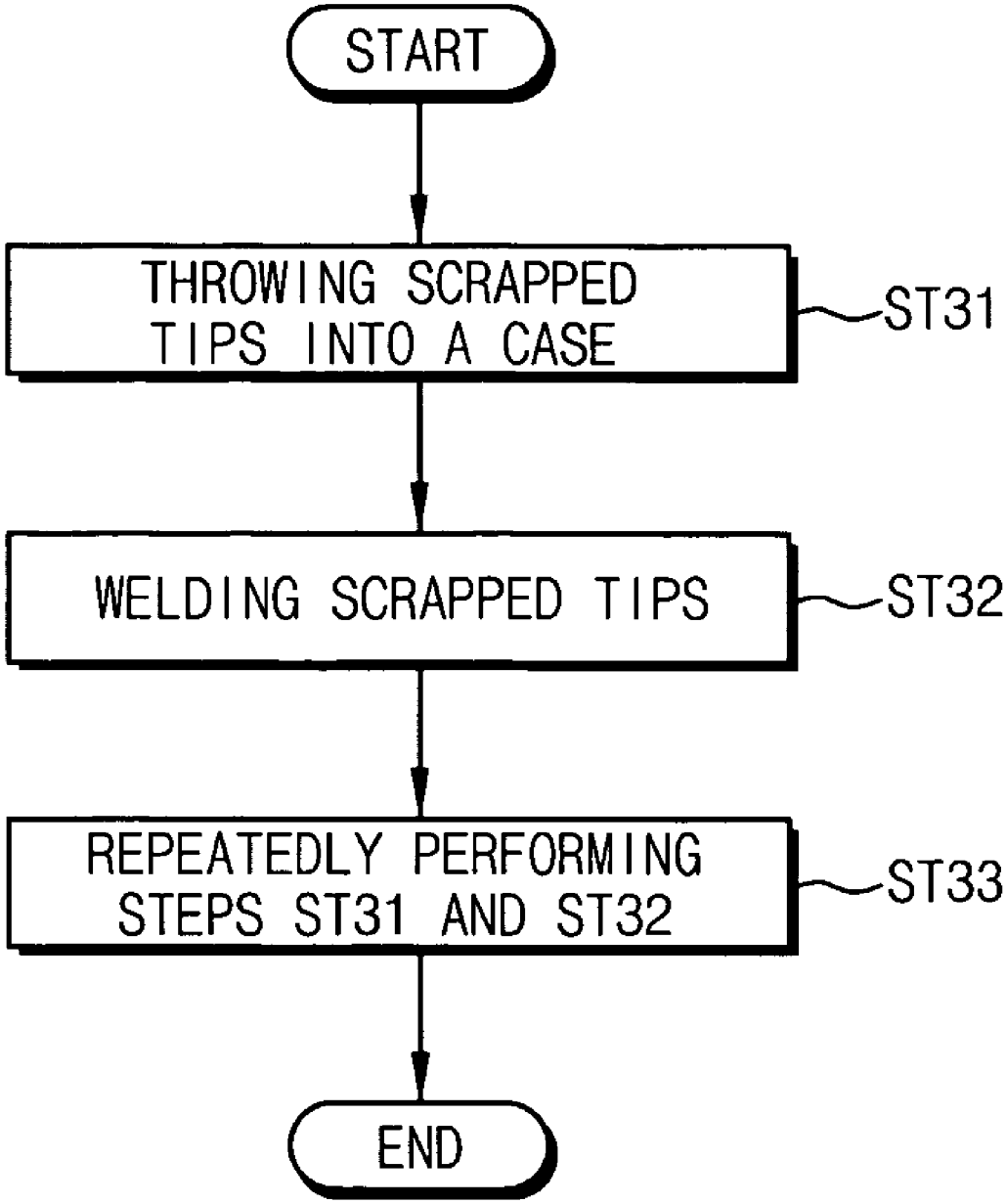
FIG. 11 is a flow chart illustrating a method of fusing scrapped tips in accordance with still another embodiment.

FIG. 11 is a flow chart illustrating a method of fusing scrapped tips in accordance with still another embodiment.

Referring to FIG. 11, in step ST31, the scrapped tips 31 are thrown into the case 200.

In step ST32, the scrapped tips 31 are welded onto the case 200 and/or the core 20 using a welding bar including copper or copper alloy.

In step ST33, other scrapped tips 11 are thrown into welded onto the case 200. The above processes are repeatedly performed to fill an inside of the case 200 with the welded scrapped tips 31.

According to the present invention, the distribution structure includes the scrapped tips including tungsten carbide so that the cheap distribution structure may have improved wear resistance. As a result, the distribution structure has a long life span so that a periodic time for exchanging the distribution structure may be prolonged.

Having described the preferred embodiments of the present invention, it is noted that modifications and variations can be made by persons skilled in the art in light of the above teachings. It is therefore to be understood that changes may be made in the particular embodiment of the present invention disclosed which is within the scope and the spirit of the invention outlined by the appended claims.

What is claimed is:

1. A distribution structure of a vertical shaft impact crusher, comprising:

a core having a hole for receiving a vertical shaft of the crusher; and a distribution member mounted on an outer face of the core, the distribution member horizontally distributing an aggregate that is downwardly thrown into the crusher, and the distribution member including a plurality of clustered scrapped tips that includes a hard metal, and a fusion material interposed between the scrapped tips to integrally connect the scrapped tips to each other.

2. The distribution structure of claim 1, wherein the scrapped tips comprise tungsten carbide.

3. The distribution structure of claim 1, wherein the fusion material comprises copper or copper alloy.

4. A vertical shaft impact crusher comprising:

a crushing housing;

a feeding hopper arranged over the crushing housing, the feeding hopper providing an aggregate to the crushing housing;

a rotor arranged in the crushing housing, the rotor providing a centrifugal force to the aggregate;

a vertical shaft for rotating the rotor to generate the centrifugal force from the rotor;

a distribution structure arranged on a bottom face of the rotor and connected to the vertical shaft, the distribution structure including a plurality of clustered scrapped tips that includes a hard metal, and a fusion material interposed between the scrapped tips to integrally connect the scrapped tips to each other; and an anvil against which the aggregate collides.

* * * * *